US006538392B2

(12) United States Patent
Kanazawa

(10) Patent No.: US 6,538,392 B2
(45) Date of Patent: Mar. 25, 2003

(54) METHOD OF DRIVING PLASMA DISPLAY PANEL

(75) Inventor: Yoshikazu Kanazawa, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 0 days.

(21) Appl. No.: 09/995,780

(22) Filed: Nov. 29, 2001

(65) Prior Publication Data

US 2002/0105278 A1 Aug. 8, 2002

(30) Foreign Application Priority Data

Feb. 5, 2001 (JP) ..... 2001-028490

(51) Int. Cl.[7] ..... G09G 3/10
(52) U.S. Cl. ..... 315/169.4; 345/67
(58) Field of Search ..... 315/169.3, 169.4, 315/169.1, 169.2; 345/204, 214, 60, 67

(56) References Cited

U.S. PATENT DOCUMENTS 4,461,978 A 7/1984 Mikoshiba et al. ..... 315/169.4
6,034,482 A * 3/2000 Kanazawa et al. ..... 315/169.1
6,054,970 A * 4/2000 Hirakawa et al. ..... 345/60
6,140,984 A * 10/2000 Kanazawa et al. ..... 315/169.4
6,262,699 B1 * 7/2001 Suzuki et al. ..... 345/60

FOREIGN PATENT DOCUMENTS

| | | |
|---|---|---|
| EP | 0 762 373 | 3/1997 |
| JP | 58-21293 | 2/1983 |
| JP | 7-134565 | 5/1995 |
| JP | 2801893 | 6/1997 |
| JP | 10-3333635 | 12/1998 |
| JP | 11-65514 | 3/1999 |

* cited by examiner

*Primary Examiner*—Don Wong
*Assistant Examiner*—Thuy Vinh Tran
(74) *Attorney, Agent, or Firm*—Staas & Halsey LLP

(57) ABSTRACT

A method of driving a plasma display panel with a further improved light emission efficiency, a high brightness, and a low power consumption has been disclosed. In the method the wall charges of a polarity opposite to that of the wall charges in the lit cell are left on the first and second electrodes in the unlit cell when the address period is completed, the sustain discharge pulses of opposite polarities have the first sustain discharge pulses of the first polarity and the second sustain discharge pulses of the polarity opposite to the first polarity, and the voltage of the first and second sustain discharge pulses overlapped by the voltage of the residual wall charges in the unlit cell are set so as to be lower than the discharge start voltage.

9 Claims, 15 Drawing Sheets

AFTER RESET DISCHARGE

AFTER ADDRESS DISCHARGE

DURING THE FIRST SUSTAIN DISCHARGE

DURING THE SECOND SUSTAIN DISCHARGE

DURING SUSTAIN DISCHARGE

AFTER RESET DISCHARGE

AFTER ADDRESS DISCHARGE

DURING FIRST SUSTAIN DISCHARGE

DURING SECOND SUSTAIN DISCHARGE

DURING SUSTAIN DISCHARGE

METHOD OF DRIVING PLASMA DISPLAY PANEL

BACKGROUND OF THE INVENTION

The present invention relates to a method of driving a plasma display panel. More particularly, the present invention relates to an art to improve the light emission efficiency of a plasma display panel.

A plasma display panel is a device in which mixed gases of such as Ne and Xe for discharge are filled in a space of about 100 $\mu$m width between two glass substrates on which electrodes are formed, a voltage greater than the discharge start voltage is applied between the electrodes to cause a discharge to occur, fluorescent materials formed on the substrates are excited to emit light by the ultraviolet rays generated by the discharge, and it is expected to be a display device that has the possibility of realizing a large-sized full-color display apparatus because of its advantages in display area, display capacity, responsiveness, and so on. Moreover, a direct view type plasma display panel of 40 to 60 inches has been realized . This size has not been realized in other display devices currently. Since the plasma display panel has been disclosed, such as in EP 0762373 A2, and is widely known, a description is omitted here.

As mentioned above, a plasma display panel has many advantages but, concerning power consumption, it is inferior to a CRT, and further improvement is demanded although a practical level has been attained in brightness. In other words, the greatest obstacle of the plasma display panel lies in improvement in the light emission efficiency, and many proposals concerning this problem have been presented. There are many methods of improvement, such as in the materials or the manufacturing process of the panel, in the driving method, and so on. Among those methods of improvement in the driving method, there are some methods of improvement in which the sustain discharge is improved.

In Japanese Unexamined Patent Publication (Kokai) No. 58-21293, the art to improve the light emission efficiency, in which the Townsend discharge is caused to occur by applying a very narrow pulse of 1 $\mu$s or less, particularly a pulse of a high voltage between sustain discharge electrodes in a plasma display of DC type in which electrodes are exposed into the discharge space, has been disclosed. Moreover, in Japanese Unexamined Patent Publication (Kokai) No. 7-134565, the art to improve the light emission efficiency of a plasma display of AC type utilizing the principle of the Townsend discharge, in which discharge electrodes are covered by dielectric materials, has been disclosed.

Furthermore, in EID98-101 (pp. 125–129) published by the Electronic Information Communication Conference, the art in which a narrow pulse of 1 $\mu$s or less and about 180 V is applied to one of discharge electrodes and, to the other electrode, a long pulse of a low voltage is applied, has been disclosed.

Still furthermore, in Japanese Unexamined Patent Publication (Kokai) No. 11-65514 and Japanese Unexamined Patent Publication (Kokai) No. 10-333635, the art in which a mixed pulse of a narrow pulse of a high voltage and a wide pulse of a low voltage are applied to sustain electrodes has been disclosed.

It is generally known that the narrower the sustain discharge pulse to be applied between sustain electrodes is, the better the light emission efficiency is, and the lower the voltage of the sustain discharge pulse is, the better the light emission efficiency is in the range where the sustain discharge is caused to occur. The above-mentioned conventional art also utilizes these characteristics, but a problem is caused when the disclosed driving method is employed. It is necessary, for example, to increase the absolute voltage (simply referred to as voltage in some cases hereinafter) of the pulse in order to generate and maintain the sustain discharge by applying narrow pulses. If, however, sustain discharge pulses of a high voltage are applied, the voltage becomes almost as high as the discharge start voltage, resulting in reduction of the operating voltage margin and an occurrence of erroneous display.

In a more concrete example, the discharge start voltage of the AC type plasma display panel currently put to practical use is about 200 V to 230 V. In the plasma display panel, the voltage of the sustain discharge pulse and wall charges are controlled so that wall charges are formed on the electrodes of a lit cell and not formed on those of an unlit cell, a sustain discharge is caused to occur in the lit cell because the voltage of the wall charged are overlapped on the sustain discharge pulse and the discharge start, voltage is exceeded, and no sustain discharge is caused to occur in the unlit cell because no voltage of the wall charges is overlapped, when the address action is completed. If the voltage of a pulse is made to be 200 V in order to generate and maintain the sustain discharge by applying the narrow pulse, there exist some unlit cells in which a discharge is caused to occur without wall charges. If a discharge is not caused to occur when sustain discharge pulses are applied several times in the beginning of the sustain discharge period, some unlit cells that are contiguous to lit cells may be lit after repeated sustain discharges because the discharge start voltage in the unlit cell is lowered by the priming effect which is caused by such as the charged particles that fly from the contiguous lit cells, resulting in erroneous display.

Moreover, if the voltage of the sustain discharge pulses is lowered, a problem is caused in that the discharge is terminated halfway because the amount of charge that move between electrodes in the sustain discharge is small and the sustain discharge cannot be continued.

For the reason's described above, it has been difficult to reduce the width of the sustain discharge pulse sufficiently and lower the voltage of the sustain discharge pulse, therefore, the improvement of the light emission efficiency has not been sufficient.

SUMMARY OF THE INVENTION

The object of the present invention is to realize a new method of driving a plasma display panel with high brightness and low power consumption by reducing the width of the sustain discharge pulse and by lowering the voltage of the sustain discharge pulse to further improve the light emission efficiency.

To realize the above-mentioned object, according to the present invention, wall charges different from those in the lit cell are left on the electrodes in the unlit cell after the reset period and the address period and before the sustain discharge period, and the sustain discharge period pulses are set asymmetrically, with these wall charges being taken into account. When the sustain discharge period pulse with a higher absolute voltage is applied, the wall charges in the unlit cell are made to act to decrease the absolute voltage so that the unlit cell is prevented from being lit. By this, in the cell (unlit cell) in which sustain discharges are not caused to occur, the absolute voltage of the sustain discharge pulse is cancelled even if it is high, therefore, the operating voltage margin can be kept wide and the range of the voltage application conditions to improve the light emission efficiency can also be widened.

For example, if the width of the sustain discharge period pulse is narrowed in the lit cell, the voltage that causes the sustain discharge to occur without fail can be applied because the absolute voltage of the sustain discharge pulse is high, and the improved effect of the light emission efficiency by narrowing the pulse width can be obtained. On the other hand, when the sustain discharge period pulse with a lower absolute voltage is applied, because the wall charges in the unlit cell serves to increase the absolute voltage, it is necessary to lower the voltage of the sustain discharge period pulse so that no discharge is caused to occur even if the voltage of the wall charges in the unlit cell is overlapped. Simultaneously, the pulse width is made longer because it is necessary to move sufficient amount of the wall charge to maintain the discharge.

Concerning the shape of the sustain discharge pulse, various modifications are available. Moreover, although the sustain discharges pulse is realized by the signals applied between the two electrodes, respectively, it is possible to modify the shape of the signals to be applied to each electrode.

There are also various methods to form different wall charges in the unlit cells. In one method, for example, wall charges of opposite polarity are left in the first and second electrodes in the reset period, and the wall charges in the unlit cell are maintained and wall charges of opposite polarity are formed in the lit cell in the address period.

In another method, the residual wall charges in the reset period are maintained in the lit cell in the address period, and wall charges of the polarity opposite to that of the residual wall charges in the reset period are formed in the unlit cell.

BRIEF DESCRIPTION OF THE DRAWINGS

The features and advantages of the invention will be more clearly understood from the following description taken in conjunction with the accompanying drawings, in which.

DESCRIPTION OF THE PREFERRED EMBODIMENTS

Figure 1:
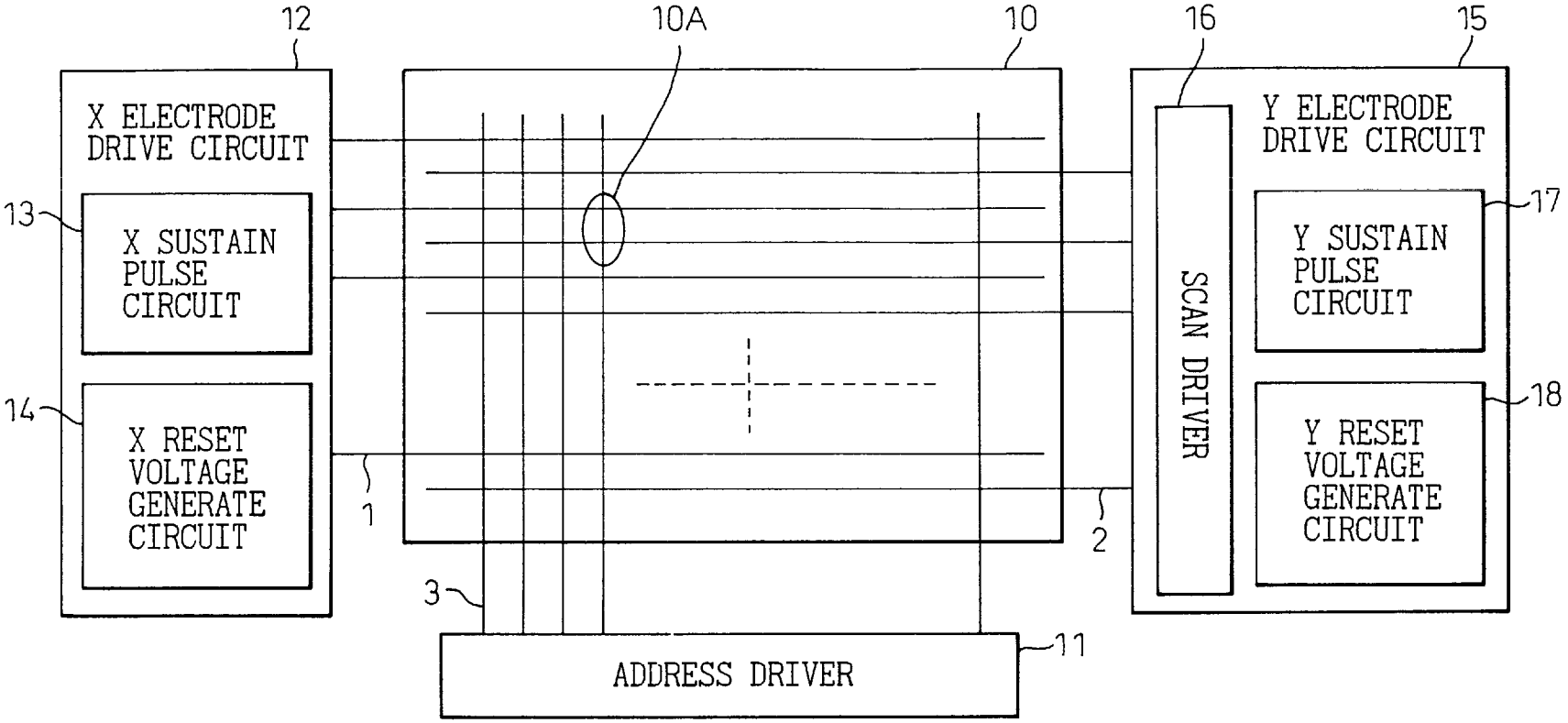
FIG. 1 is a diagram that shows a rough structure of the plasma display apparatus in the first embodiment of the present invention.

FIG. 1 is a diagram that shows a rough structure of the plasma display apparatus in the first embodiment of the present invention. On a display panel 10, a first electrode 1 and a second electrode 2 are formed in parallel, and a third electrode 3 is formed perpendicular to them. The first electrode and the second electrode are electrodes that carry out sustain discharges mainly for light emission for display, and the first electrode is referred to as the X electrode and the second electrode as the Y electrode, here. Sustain discharges are caused to occur by applying voltage pulses repeatedly between the X electrode and the Y electrode. Moreover, either one of the electrodes works as a scan electrode to write display data (in this example, the Y electrode is the scan electrode), the third electrode is an electrode to select display cells to be lit in each display line, and a voltage is applied between either the first or the second electrode and the third electrode to cause write discharges to select discharge cells. The third electrode is referred to as the address electrode here. These electrodes are connected to drive circuits to generate voltage pulses according to their purposes. As shown schematically, the X electrodes are connected to an X electrode drive circuit 12 and applied with common drive signals. The X electrode drive circuit 12 comprises an X sustain pulse circuit 13 and an X reset voltage generate circuit 14. The Y electrodes are connected to a Y electrode drive circuit 15. The Y electrode drive circuit 15 comprises a scan driver 16, a Y sustain pulse circuit 17, and a Y reset/address voltage generate circuit 18. The address electrodes are connected to an address driver 11. In general, each drive circuit is composed of MOS-FETs, and so on, and this also applies to the present embodiment. Since the display apparatus employing the plasma display panel has detailedly been disclosed in such as EP 0762373A2, a description is not provided here.

Figure 2:
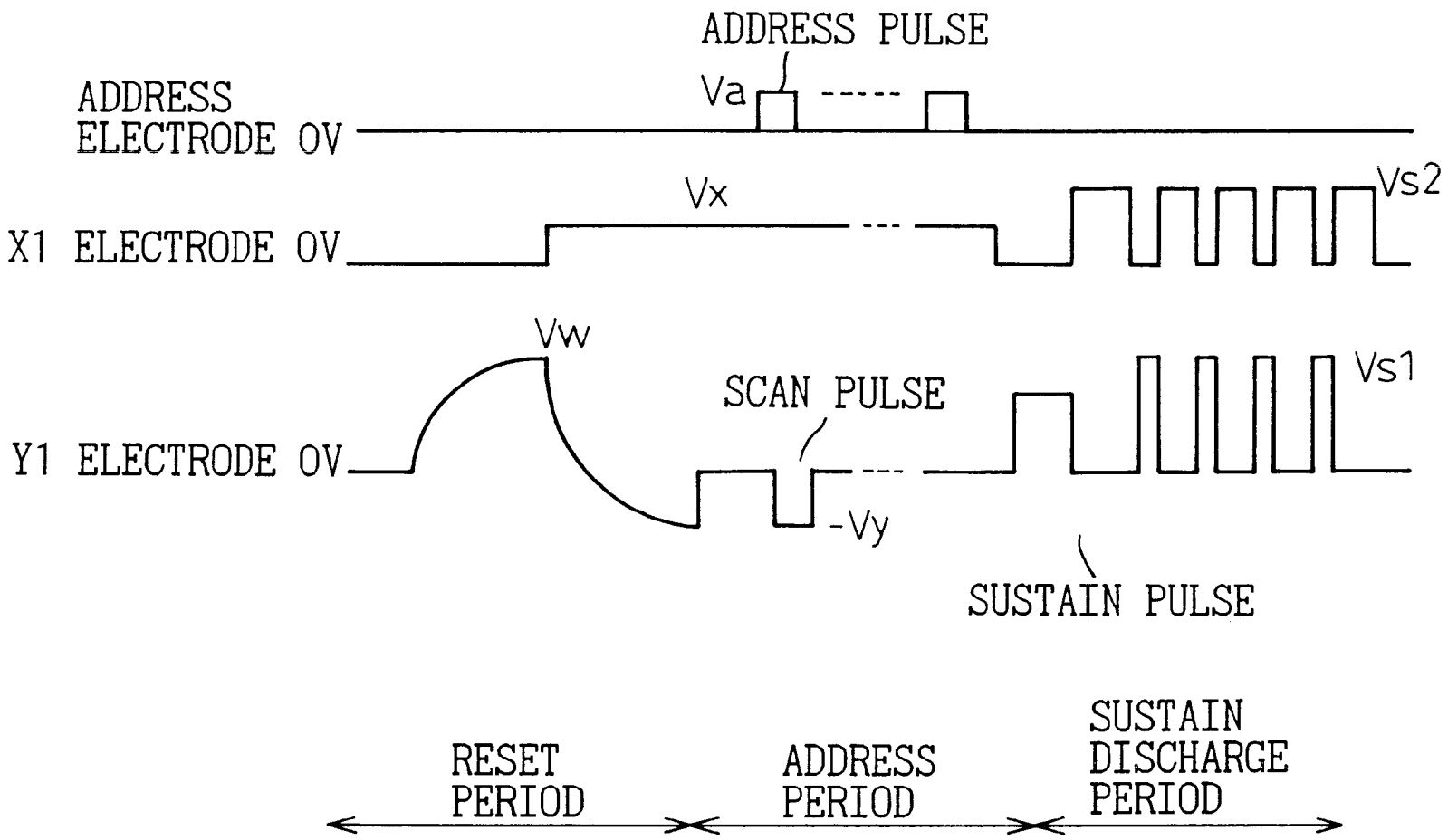
FIG. 2 is a chart that shows the drive waveforms of the plasma display apparatus in the first embodiment.

FIG. 2 is a chart that shows the drive waveforms of a subfield of the plasma display apparatus in the first embodiment, and FIG. 3A through FIG. 3E are diagrams that show the changes on the electrodes and the states of discharges in the first embodiment. Each subfield comprises: the reset period in which an action is performed to set all the cells to a uniform state, for example a state in which wall charges are erased, regardless of the lighting condition in the previous subfield; the address period in which selective discharges (address discharge) are caused to occur to determine the lit or unlit state of each cell according to display data; and the sustain discharge period (referred to as the sustain period) in which discharges are repeatedly caused to occur in the lit cell by applying sustain discharge pulses between the sustain electrodes and discharges for display are caused to occur. In the present invention, wall charges are formed also in the unlit cells before the sustain discharge period is initiated.

In the reset period, as shown in FIG. 2, a write pulse that increases gradually to the voltage Vw (higher than Vs and about 300 V) is applied to the Y electrode. By this pulse, weak discharges are caused to occur both intermittently and continuously in all the cells and wall charges are formed. The formed wall charges are negative on the Y electrode and positive on the X electrode and the address electrode. Subsequently, with Vx (about 70 V) being kept applied to the X electrode, an erase pulse that decreases gradually to −Vy (about −100 V) is applied to the Y electrode. By this pulse, weak discharges are caused to occur both intermittently and continuously and the previously formed wall charges are erased little by little. When this pulse is completed, a small amount of negative charges remains on the Y electrode, and a small amount of positive charges, on the X electrode and the address electrode, respectively. These residual charges remain in the unlit cell where no address discharge is caused to occur and serve as suppress wall charges to prevent erroneous discharges, and contribute effectively to the address discharges in the lit cell where the address discharge is caused to occur.

Figure 3A:
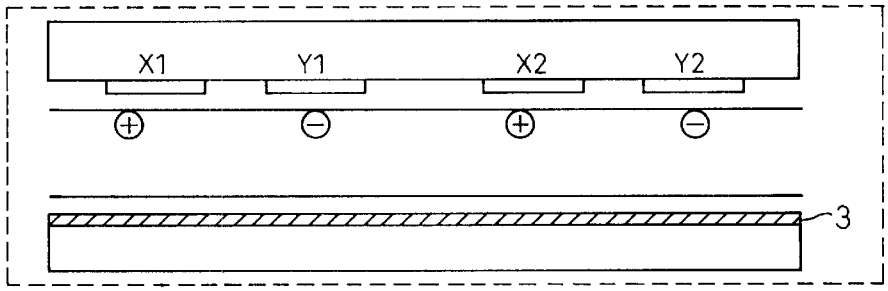
FIG. 3A through FIG. 3E are diagrams that show the changes of the wall charges on the electrodes and the states of discharges in the first embodiment.
Figure 3B:
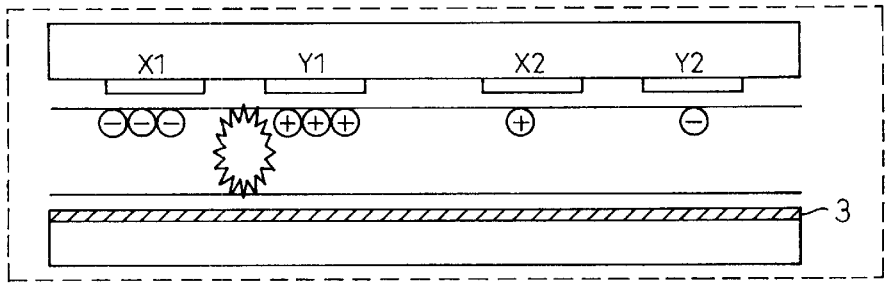

In the address period, with Vx being kept applied to the X electrode, scan pulses of −100 V are applied to the Y electrode sequentially, and address pulses of Va voltage (about 50 V) are.applied to the address electrodes of the lit cells of the line to which the scan pulses are applied. By this, an address discharge is caused to occur between the X1 electrode and the Y1 electrode in the lit cell, and many negative charges are formed on the X1 electrode, and many positive electrodes on the Y1 electrode, as shown in FIG. 3B. Since no discharge is caused to occur in the unlit cell, the charges, when the reset period is completed, are left as is. The voltage of the wall charges formed by the address discharge is greater in absolute value than that of the residual charges when the reset period is completed, and the polarities of these voltages are opposite to each other. In the event that no wall charges are left when the reset period is completed, the address pulse of 50 V is required and lit is necessary to apply the scan pulse of −150 V or greater to the Y electrode, but in this embodiment, the voltage of the residual wall charges when the reset period is completed is about 50 V, therefore, the scan pulse can made to be −100 V as shown above.

Figure 3C:
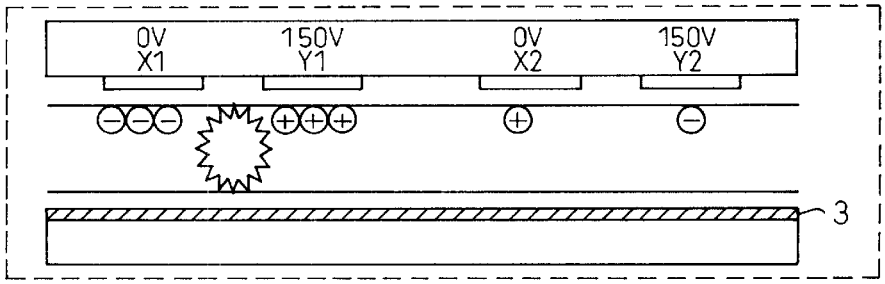

Next, the sustain discharge period follows. As shown in FIG. 3C, during the initial first sustain discharge, the X electrode is set to 0 V, and the wide sustain discharge pulse of Vs2 voltage (about 150 V) is applied to the Y electrode. In the lit cell, a discharge is caused to occur because the wall charges formed on the X1 electrode are overlapped on those formed on the Y1 electrode and the discharge start voltage is exceeded, but the residual wall charges on the X2 electrode and the Y2 electrode have the opposite polarities to each other in the unlit cell and the discharge start voltage is not reached, therefore, no discharge is caused to occur. The first sustain discharge starts in the lit cell where the address discharge has been caused to occur and accumulates the wall charges for the second sustain discharge and the latter that follow as well as generates space charges that will be the foundation of the priming effect.

Figure 3D:
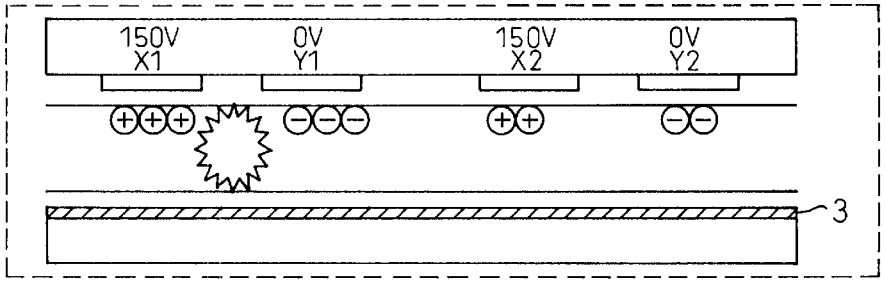

Next, during the second sustain discharge, as shown in FIG. 3D, the Y electrode is set to 0 V, and the wide sustain discharge pulse of the low Vs2 voltage is applied to the X electrode. At this time, the voltage of the wall charges in the lit cell and that of the wall charges in the unlit cell have the same polarity and collaborate to increase the absolute voltage between the X electrode and the Y electrode. Because of the large absolute voltage of the wall charges in the lit cell and the priming effect of the first sustain discharge, a discharge is caused to occur even by the sustain discharge pulse of the low Vs2 voltage in the lit cell and wall charges are formed, but no discharge is caused to occur in the unlit cell because the absolute voltage of the wall charges remaining on the X2 electrode and the Y2 electrode is low and there is no priming effect.

Figure 4:
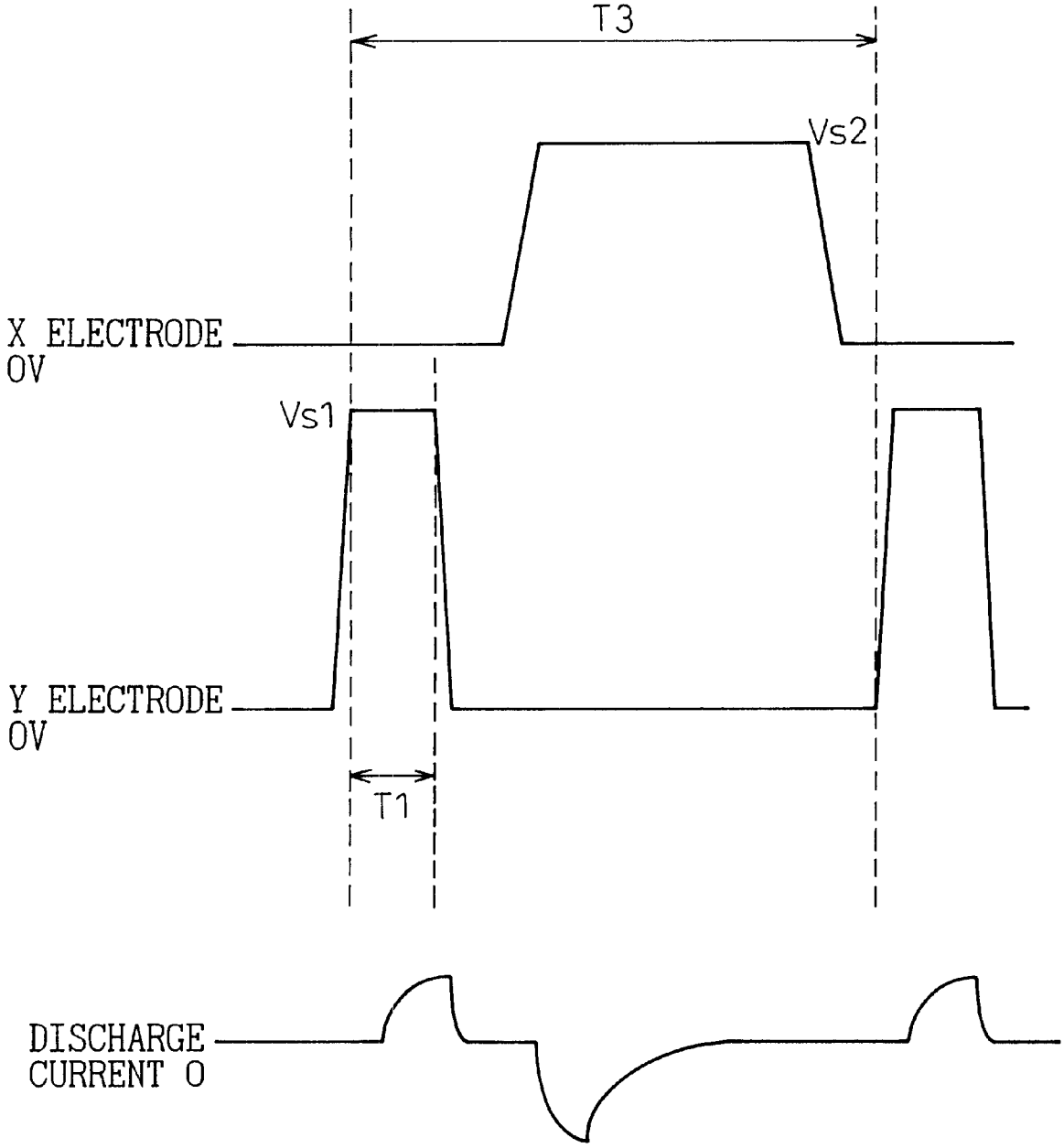
FIG. 4 is a diagram that shows the sustain discharge pulse in the driving method in the first embodiment.

Then, the sustain discharge pulses as shown in FIG. 4 are applied repeatedly to the X electrode and the Y electrode with the period of T3. In other words, with the X electrode being set to 0 V, the pulse of a narrow width of T1 and of the high Vs1 voltage (about 200 V) is applied to the Y electrode, then with the Y electrode being set to 0 V, the pulse of a width wider than T1 and of the Vs2 voltage (about 150 V) are applied to the X electrode. The condition where the voltage Vs2 is applied to the X electrode is the same as that in the FIG. 3D shown above.

Figure 3E:
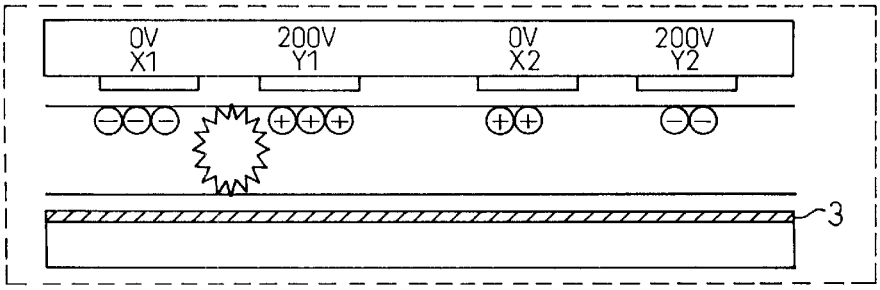

As shown in FIG. 3E, because of not only the applied high voltage Vs1 but also the wall charges formed by the second sustain discharge and the priming effect, a discharge is caused to occur in the lit cell, but no discharge is caused to occur in the unlit cell even if the high voltage Vs1 is greater than the discharge start voltage (about 200 V) because the voltages of the residual wall charges on the X2 electrode and the Y2 electrode have the opposite polarities to each other and there is no priming effect. The discharge current is less than that by the conventional sustain discharge pulse as shown in FIG. 4 because the voltage is removed within a time as short as 1 $\mu$s or less in the discharge in the lit cell and therefore the discharge ends before the peak of the second electron release caused by the movement of ions to the cathode. A sufficient amount of light emission, however, can be obtained because much ultraviolet light is radiated to excite the fluorescent materials in the initial state of the pulse application. In other words, an efficient discharge can be realized. This discharge forms many wall charges because the applied voltage is great.

Next, in a similar way as that in FIG. 3D, with the Y electrode being set to 0 V, a comparatively wide sustain discharge pulse of the low Vs2 voltage is applied to the X electrode, and this time a discharge is caused to occur without fail in the lit cell because many wall charges are formed by the discharge just before, as shown in 3E, and there is the priming effect, but no discharge is caused to occur in the unlit cell. The scale of the discharge at this time in the lit cell is small because the applied voltage is lower compared to a conventional one and the discharge current is kept small as shown in FIG. 4. As widely known conventionally, however, the light emission efficiency is excellent because of the low voltage.

Figure 5A:
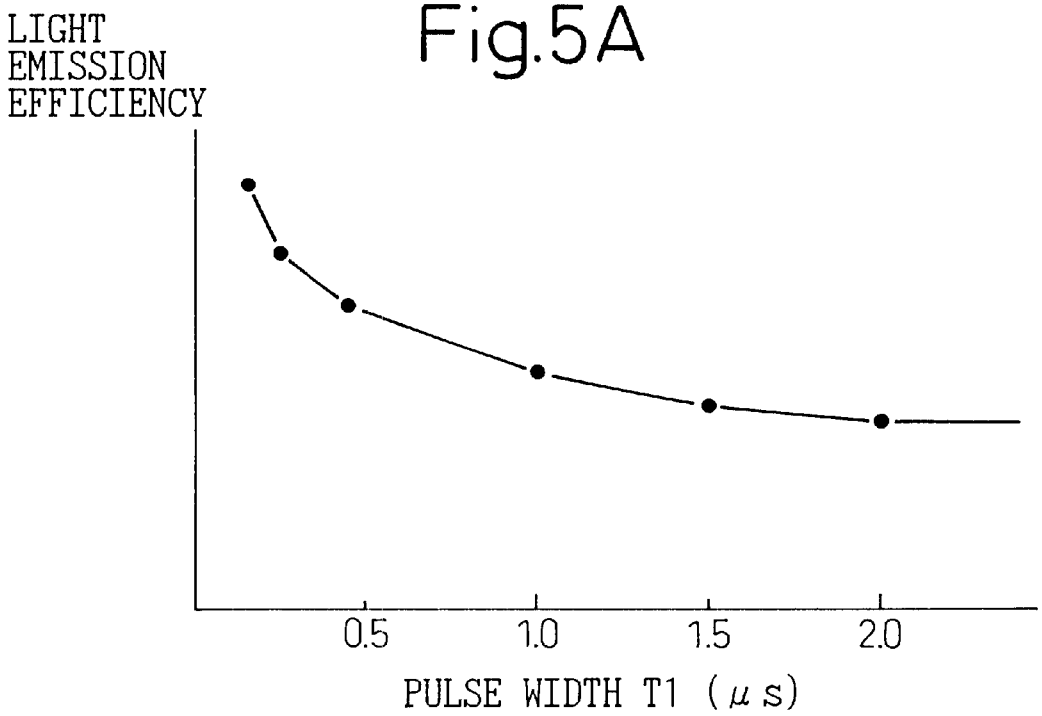
FIG. 5A and FIG. 5B are diagrams that show the light emission efficiency in the driving method of the present invention.
Figure 5B:
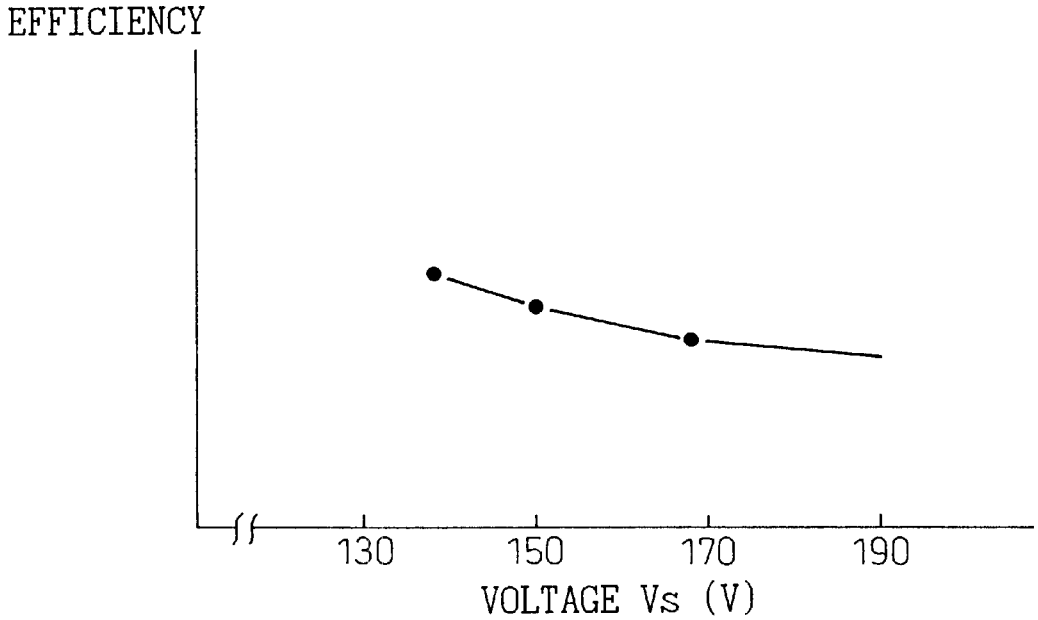

The relation between the pulse width of the sustain discharge pulse and the light emission efficiency and that between the voltage of the sustain discharge pulse and the light emission efficiency are shown in FIG. 5A and FIG. 5B, respectively. FIG. 5A shows the relation between the pulse width T of the sustain discharge pulse and the light emission efficiency. As known conventionally, and also in this embodiment, the narrower the pulse width is, the higher the light emission efficiency is, in the range of 1 $\mu$s or less of the pulse width. FIG. 5B shows the relation between the voltage Vs of the sustain discharge pulse and the light emission efficiency. As also known conventionally, the lower the voltage is, the higher the light emission efficiency is. Although a high efficiency can be realized by applying only sustain discharge pulses of low voltage repeatedly to the X electrode and the Y electrode, a voltage range of 160 V or less cannot be put to practical use, because the amount of the formed wall charges is small and the drop in voltage caused by the impedance of the electrode resistance and the circuits when the number of the cells to be lit in the panel increases, the changes of the discharge characteristics of the panel caused by the temperature change or time elapse, and so on, cannot be compensated for. In this embodiment, however, since the narrow pulses of the high voltage to be applied to the Y electrode are used in combination with the sustain discharge pulses of a low voltage, it is possible to use a voltage as low as 150 V, which is lower than a conventional one. Moreover, since the voltage of Vs1 is high, it is possible to further lower the voltage of Vs2. In other words, in this invention, the improvement of the light emission efficiency due to, the low voltage sustain discharge and that due to the high voltage narrow pulses are combined.

Figure 6:
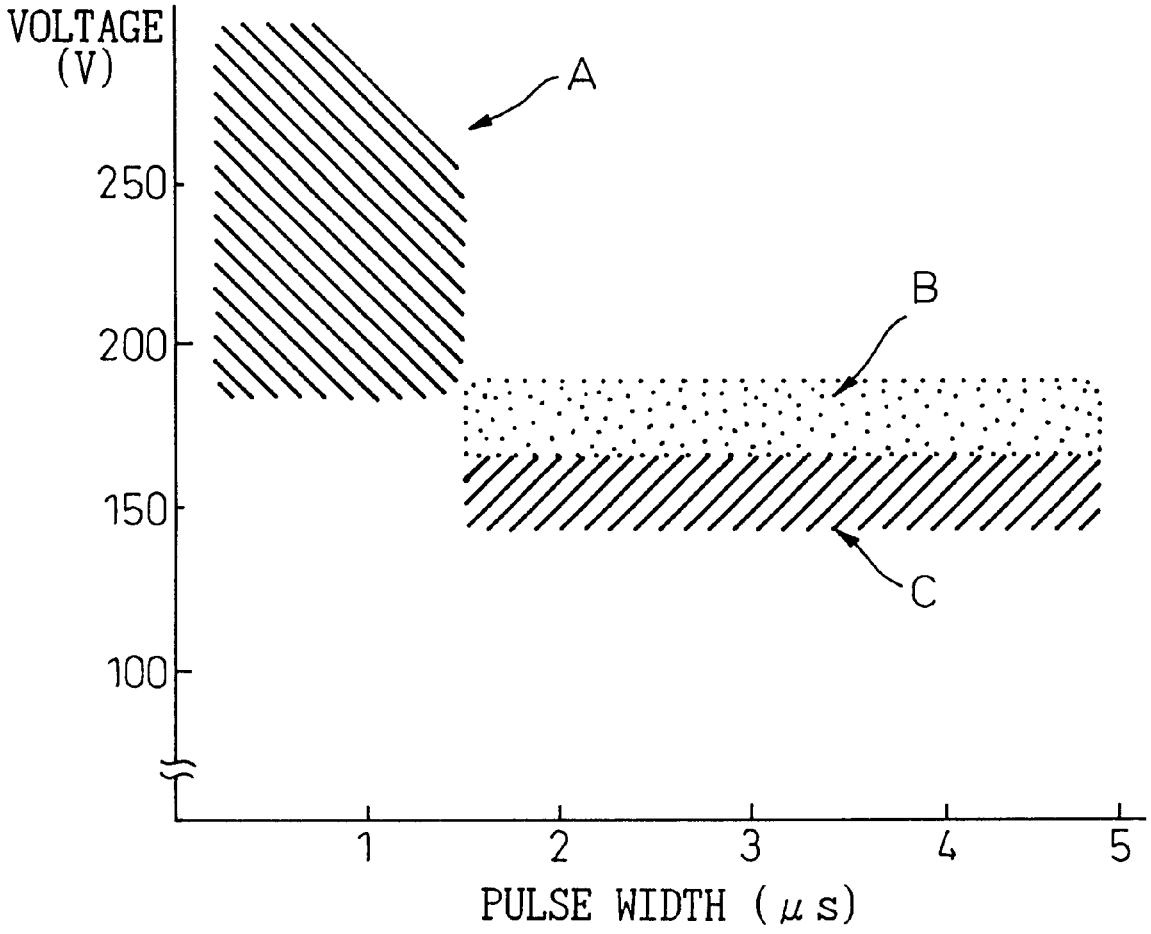
FIG. 6 is a diagram that shows the operating range of the sustain discharge pulse in the driving method of the present invention.

FIG. 6 is a diagram that shows the relation of the setting range between the width and the voltage of the sustain discharge pulse of the present invention. The area B is the setting range of the conventional sustain discharge pulse, the pulse width of which is about 2 $\mu$s or more, and the voltage of which is approximately between 160 V and 180 V. The area A is the setting area of the high voltage narrow pulse of the present invention. The area C is the setting area of the low voltage wide pulse. Although moving the setting values from the area C to the area B causes no problem, the light emission efficiency is degraded.

The plasma display apparatus in the first embodiment is described above, and there can be various modifications such as a method in which different charges are left on the X electrode and the Y electrode in the unlit cell, a modification concerning the sustain discharge pulse, and so on. These modifications are described in the following embodiments, but the description is provided only partially and the present invention is not limited to these modifications.

Figure 7:
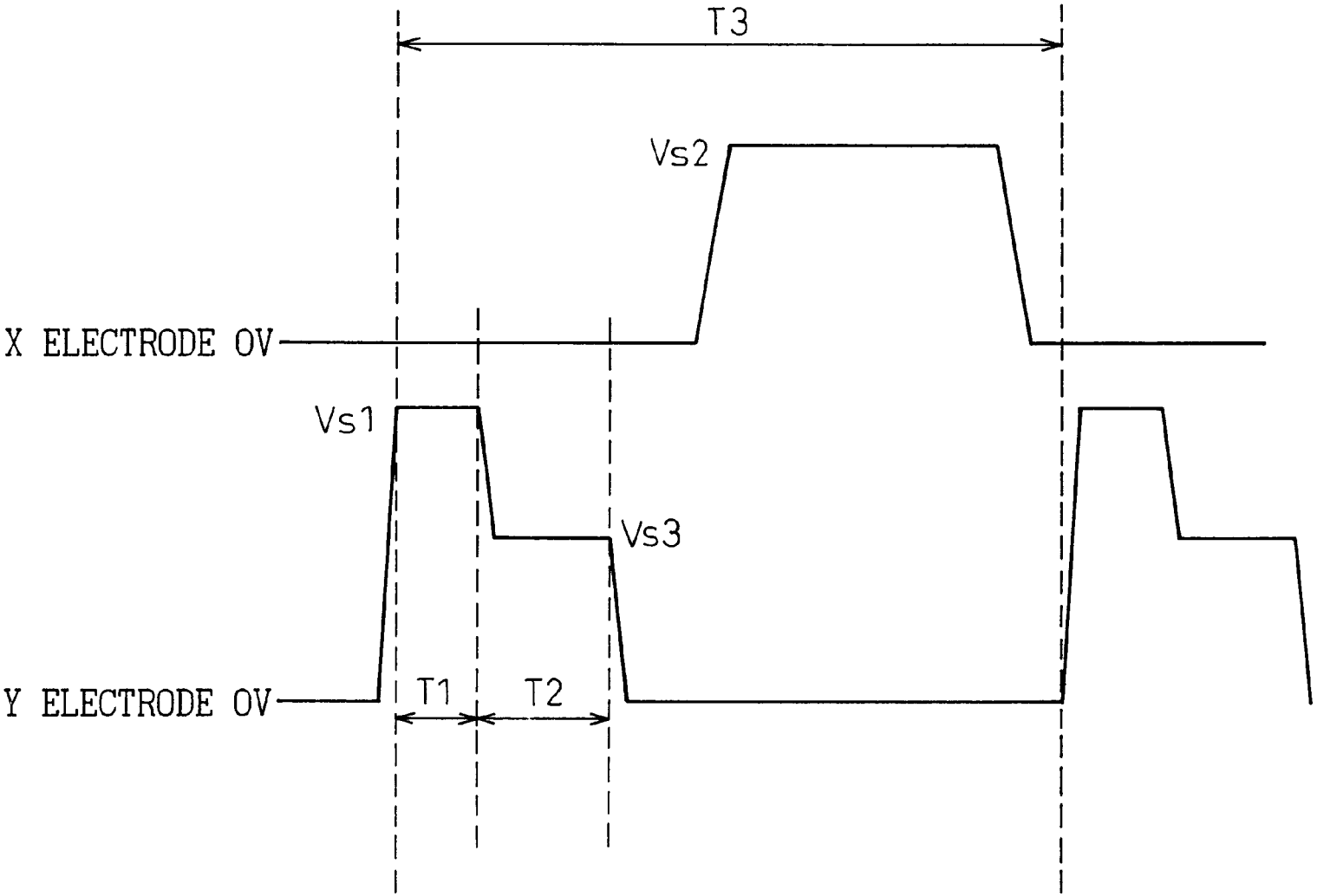
FIG. 7 is a diagram that shows an example of the modified sustain discharge pulse.

FIG. 7 is a diagram that shows an example of the modified sustain discharge pulse. These waveforms of the sustain discharge pulse differ from those in FIG. 4 in that the low voltage pulse (voltage is Vs3 and the width is T2) is applied subsequently after the narrow high voltage pulse (voltage is Vs1 and width is T1) that is applied to the Y electrode. In the period T2, part of the space charges generated by the discharge during the period T1 is accumulated as wall charges and this will provide the effect that the discharge by the sustain discharge pulse to be applied to the X electrode is made stable. Moreover, by adding this pulse, the voltage Vs2 of the sustain pulse to be applied to the X electrode can be lowered. In this example, Vs1 is 200 V, Vs2 and Vs3 are 150 V, T1 is 1.0 $\mu$s, and T2 is 2 $\mu$s.

Figure 8:
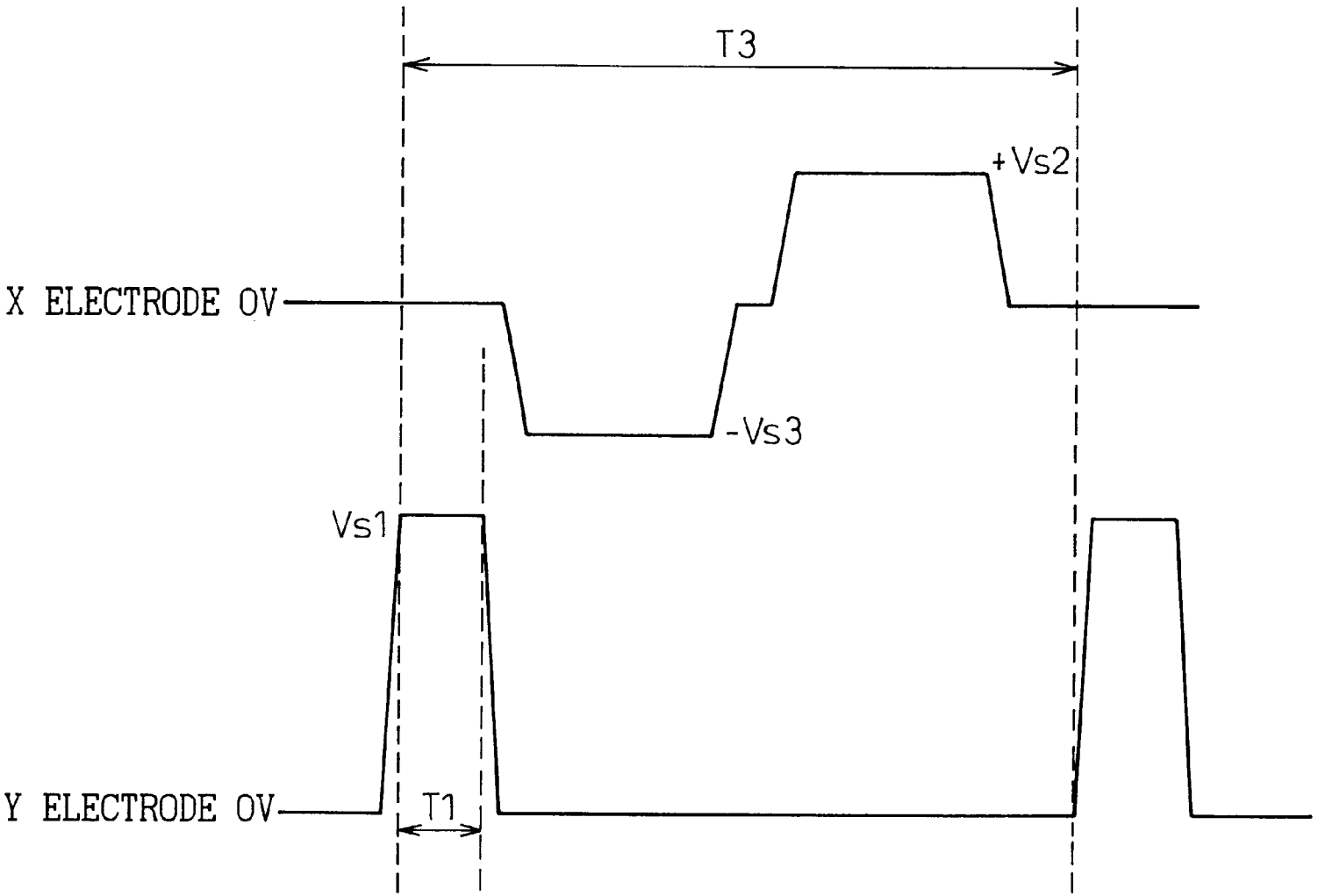
FIG. 8 is a diagram that shows an example of the modified sustain discharge pulse.

FIG. 8 is a diagram that shows another example of the modified sustain discharge pulse. This sustain discharge, pulse has a voltage that is effectively applied to the discharge cell, which is identical with that of the sustain discharge pulse in FIG. 7, but the voltage to be applied to each electrode is different. It is necessary for the sustain discharge pulse in FIG. 7 to generate two different voltages to be applied to the Y electrode, but the sustain discharge pulse in FIG. 8 needs to generate only the voltage +Vs2 that is applied to the X electrode, therefore, the circuit can be simplified. Although there are two voltages +Vs2 and −Vs3 to be applied to the X electrode, the voltage generating circuit can be shared by setting Vs2=Vs3, resulting in the simplified circuit that generates the voltage to be applied to the X electrode.

Figure 9:
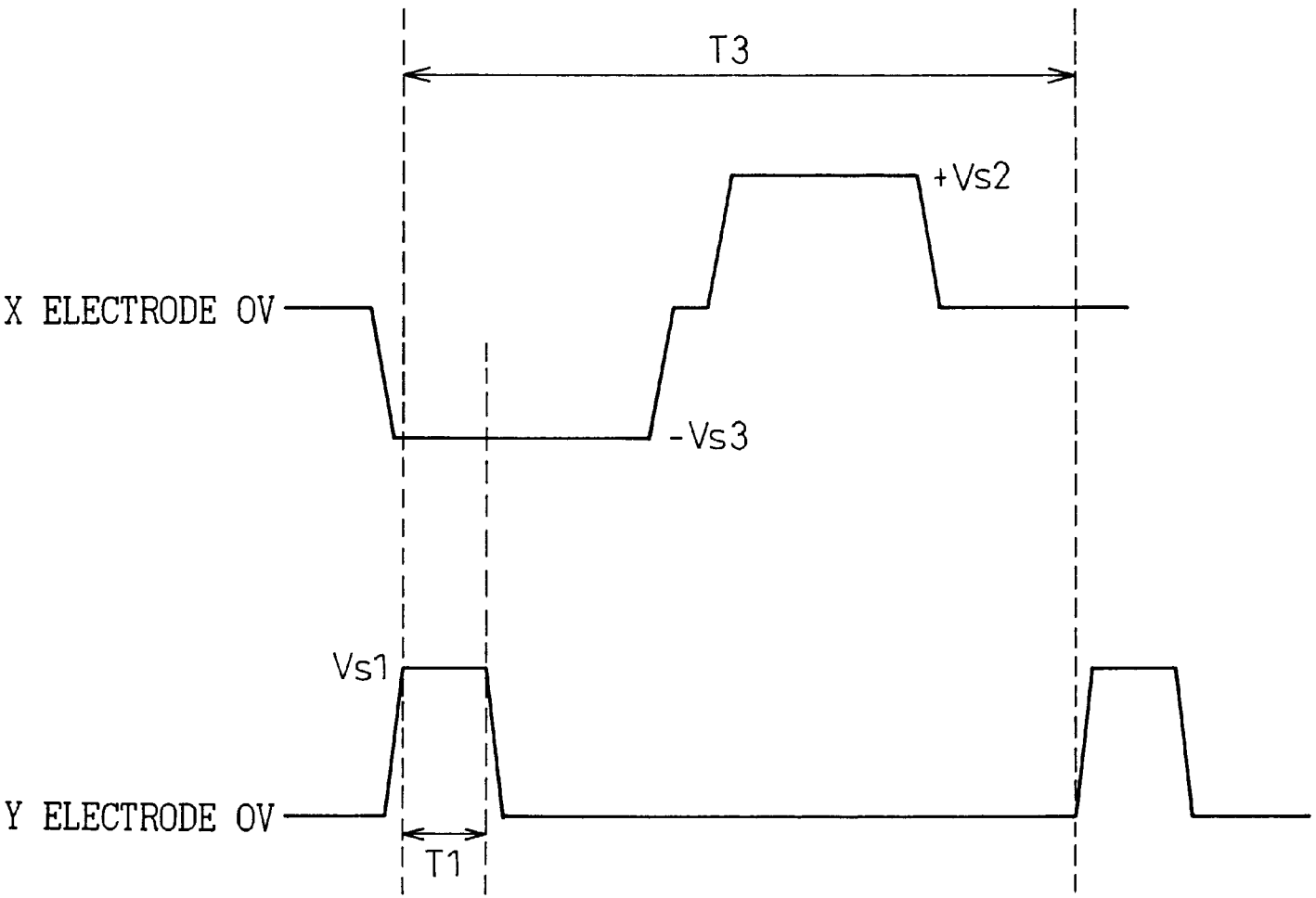
FIG. 9 is a diagram that shows an example of modified sustain discharge pulse.

FIG. 9 is a diagram that shows another example of the modified sustain discharge pulse. This sustain discharge pulse has a voltage that is effectively applied to the discharge cell, which is identical with those of the sustain discharge pulses in FIG. 7 and FIG. 8, but the voltage to be applied to each electrode is different. The waveforms of the sustain discharge pulse in FIG. 9 differ from those in FIG. 8 in that the voltage −Vs3 is applied to the X electrode at the same time as the voltage Vs1 is applied to the Y electrode, and the voltage of the narrow pulse is set to Vs1+Vs3. By setting Vs1=Vs2=Vs3, the circuit to generate the voltage to be applied can further be simplified because the voltage generating circuit can be shared.

Figure 10:
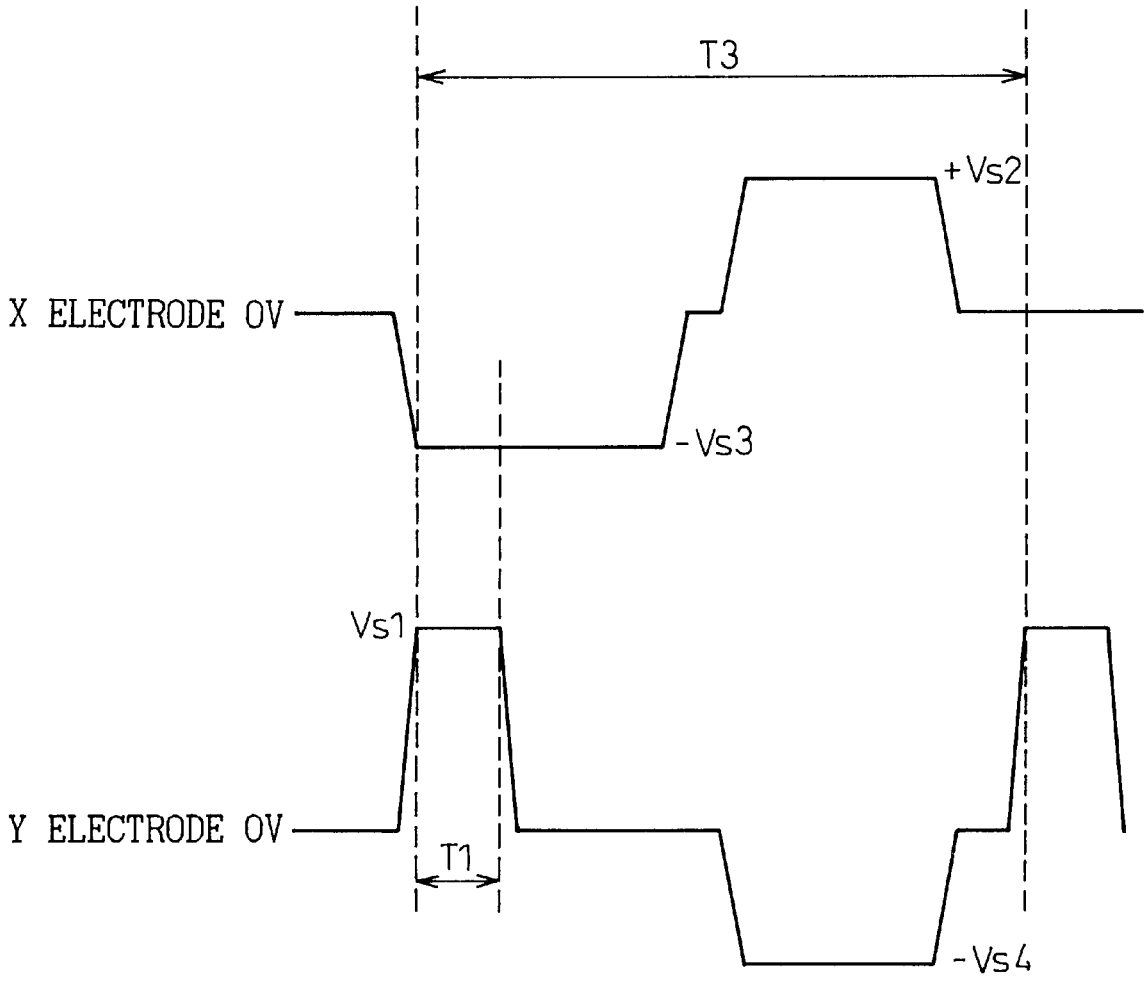
FIG. 10 is a diagram that shows an example of the modified sustain discharge pulse.

FIG. 10 is a diagram that shows another example of the modified sustain discharge pulse. This sustain discharge pulse has the voltage that is effectively applied to the discharge cell, which is identical with that of the sustain discharge pulse in FIG. 7 through FIG. 9, but the voltage to be applied to each electrode is different. The sustain discharge pulse in FIG. 10 applies the voltage −Vs4 to the Y electrode at the same time as it applies the voltage Vs2 to the X electrode, and the voltage of the wide pulse is set to Vs2+Vs4. By setting Vs2=Vs3=Vs4;, the voltage generating circuit can be shared. Vs1, however, cannot be made equal to Vs2, Vs3, or Vs4.

Figure 11:
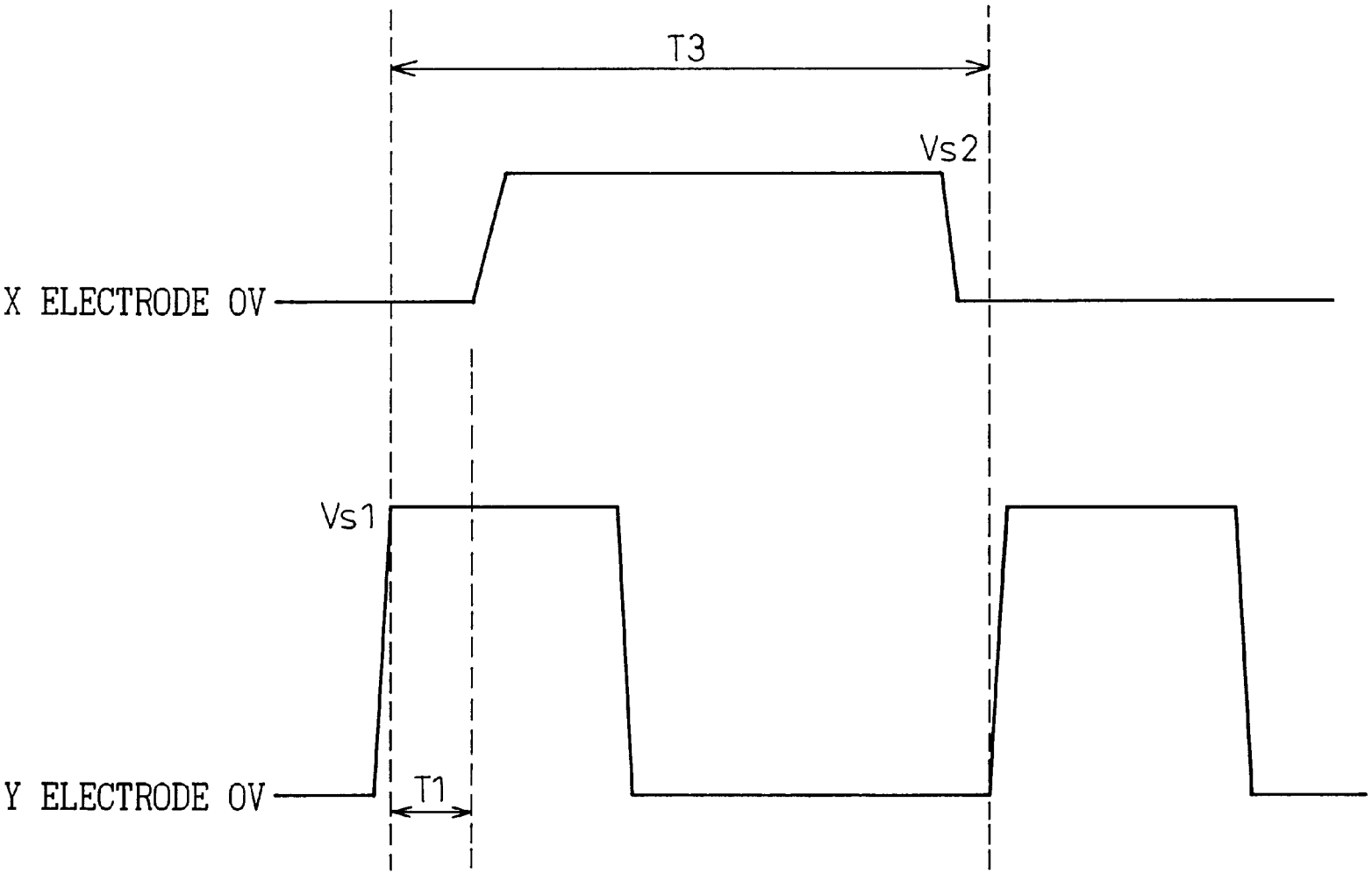
FIG. 11 is a diagram that shows an example of the modified sustain discharge pulse.

FIG. 11 is a diagram that shows another example of the modified sustain discharge pulse. This sustain discharge pulse has the voltage that is effectively applied to the discharge cell, which is similar to that of the sustain discharge pulse in FIG. 7 through FIG. 9, but the voltage to be applied to each electrode is different. Concerning the sustain discharge pulse in FIG. 11, although the pulse width of the voltage Vs1 to be applied to the Y electrode is wide, the voltage to be applied to the discharge cell becomes Vs1−Vs2 because the voltage Vs2 is applied to the X electrode after the period T1, therefore, the period during which a high voltage is applied is as short as T1. In this example, the voltage to be applied to each X electrode and Y electrode is the same type of the voltage of the same polarity, therefore, the circuit can be simplified compared to the chase where the sustain discharge pulse in FIG. 7 is used.

Figure 12:
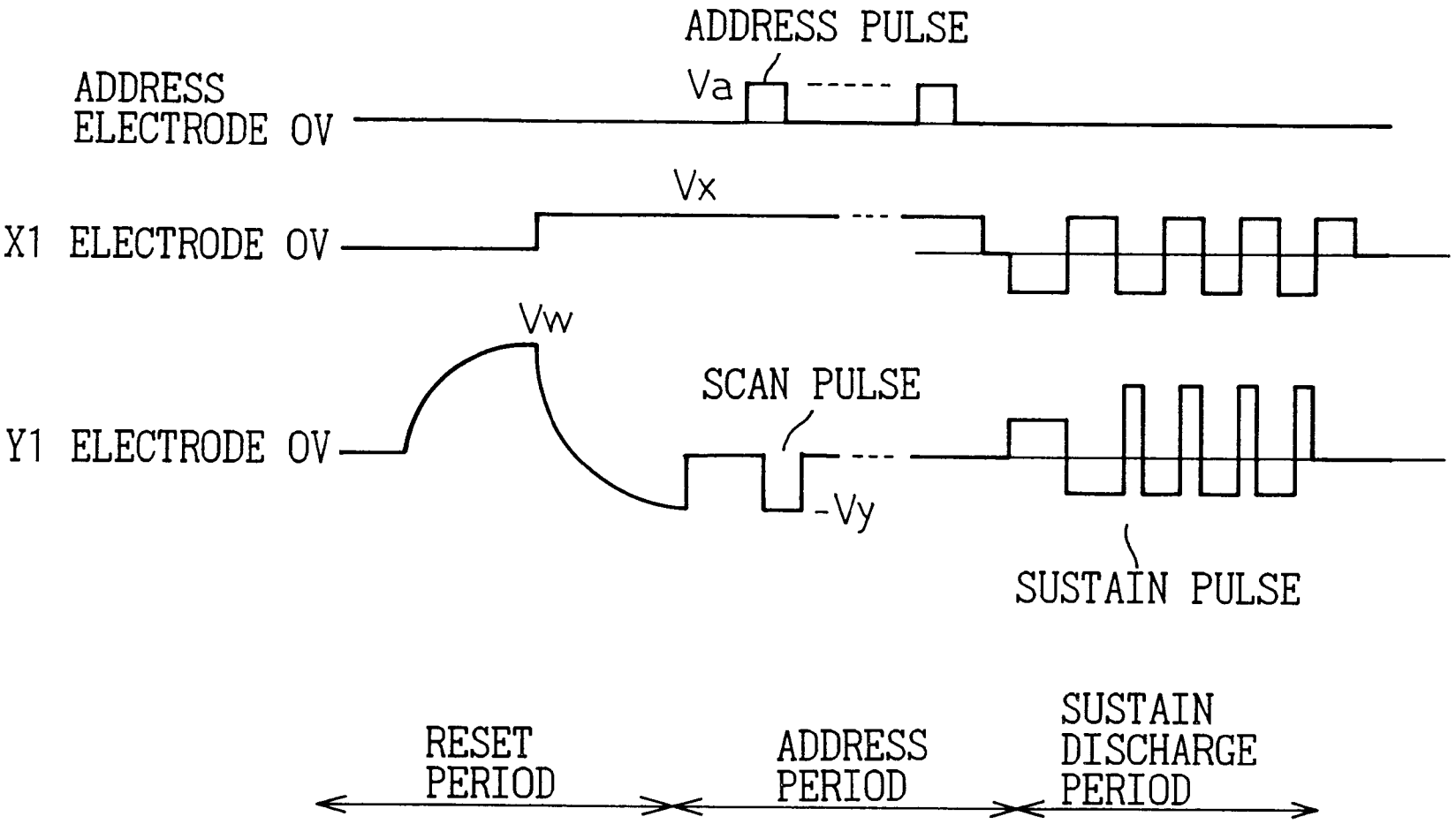
FIG. 12 is a diagram that shows the drive waveforms of the plasma display apparatus in the, second embodiment of the present invention.

FIG. 12 is a diagram that shows the drive waveforms of the plasma display apparatus in the second embodiment of the present invention. The plasma display apparatus in the second embodiment has a structure similar to that in the first embodiment shown in FIG. 1, and is different from that in the first embodiment in that the sustain discharge pulse in the sustain discharge period has the waveforms in FIG. 10. The voltage −Vy of the scan pulse to be applied to the Y electrode in the address period is made equal to the voltage −Vs4 to be applied to the Y electrode in the, sustain discharge period, and the power circuit and the Y electrode drive circuit 15 can be simplified. Similarly, the voltage Vx to be applied to the X electrode in the reset period and the address period is made equal to the voltage −Vs2 to be applied to the X electrode in the sustain discharge period, and the power circuit and the X electrode drive circuit 12 can be simplified.

Figure 13:
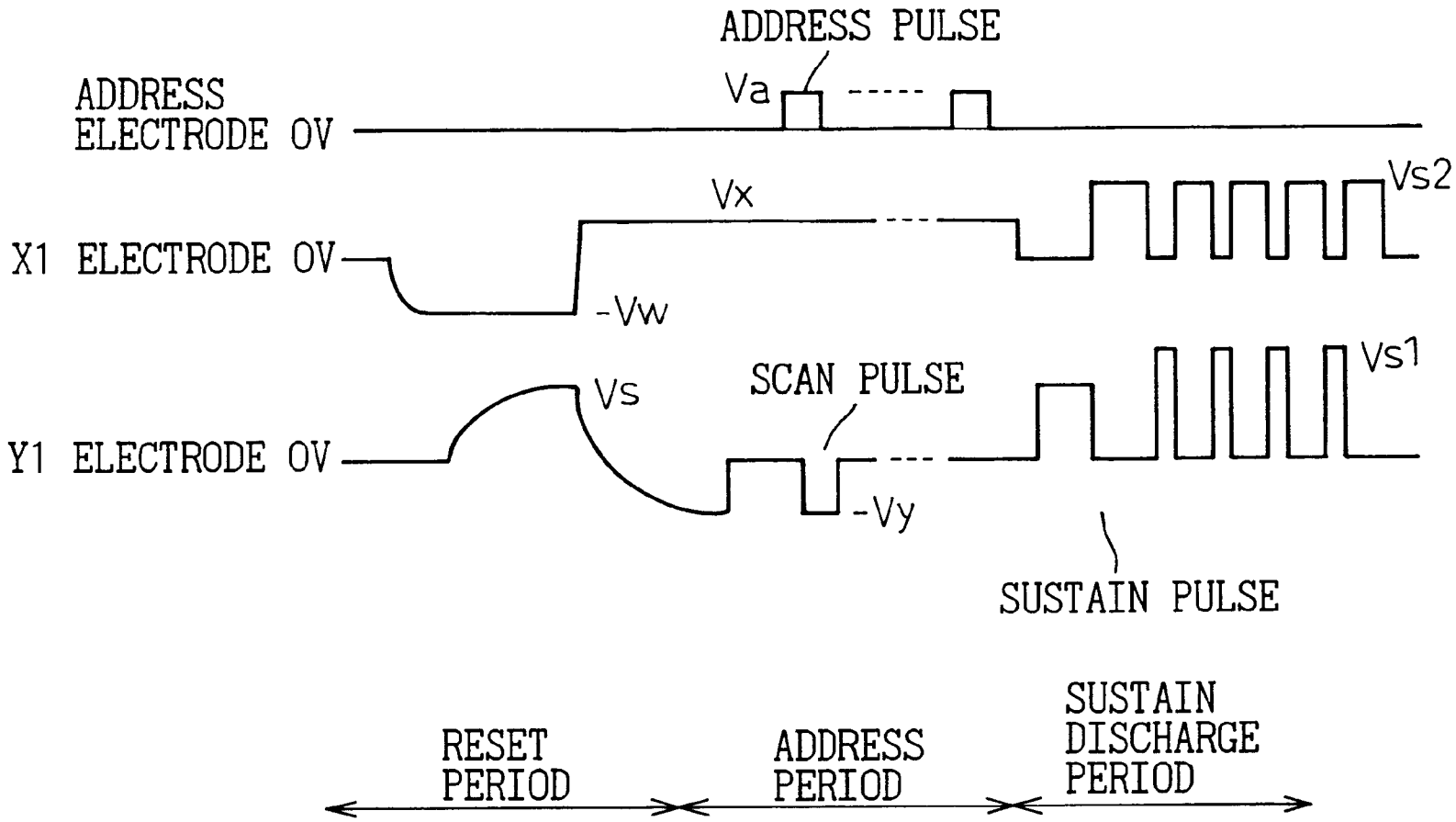
FIG. 13 is a diagram that shows the drive waveforms of the plasma display apparatus in the third embodiment of the present invention.

FIG. 13 is a diagram that shows the drive waveforms of the plasma display apparatus in the third embodiment of the present invention. The plasma display apparatus in the third embodiment has a structure similar to that in the first embodiment shown in FIG. 1, and is different from that in the first embodiment in that the application of the write pulses in the reset period is performed separately to the X electrode and the Y electrode. The other waveforms are the same as those in the first embodiment.

Figure 14:
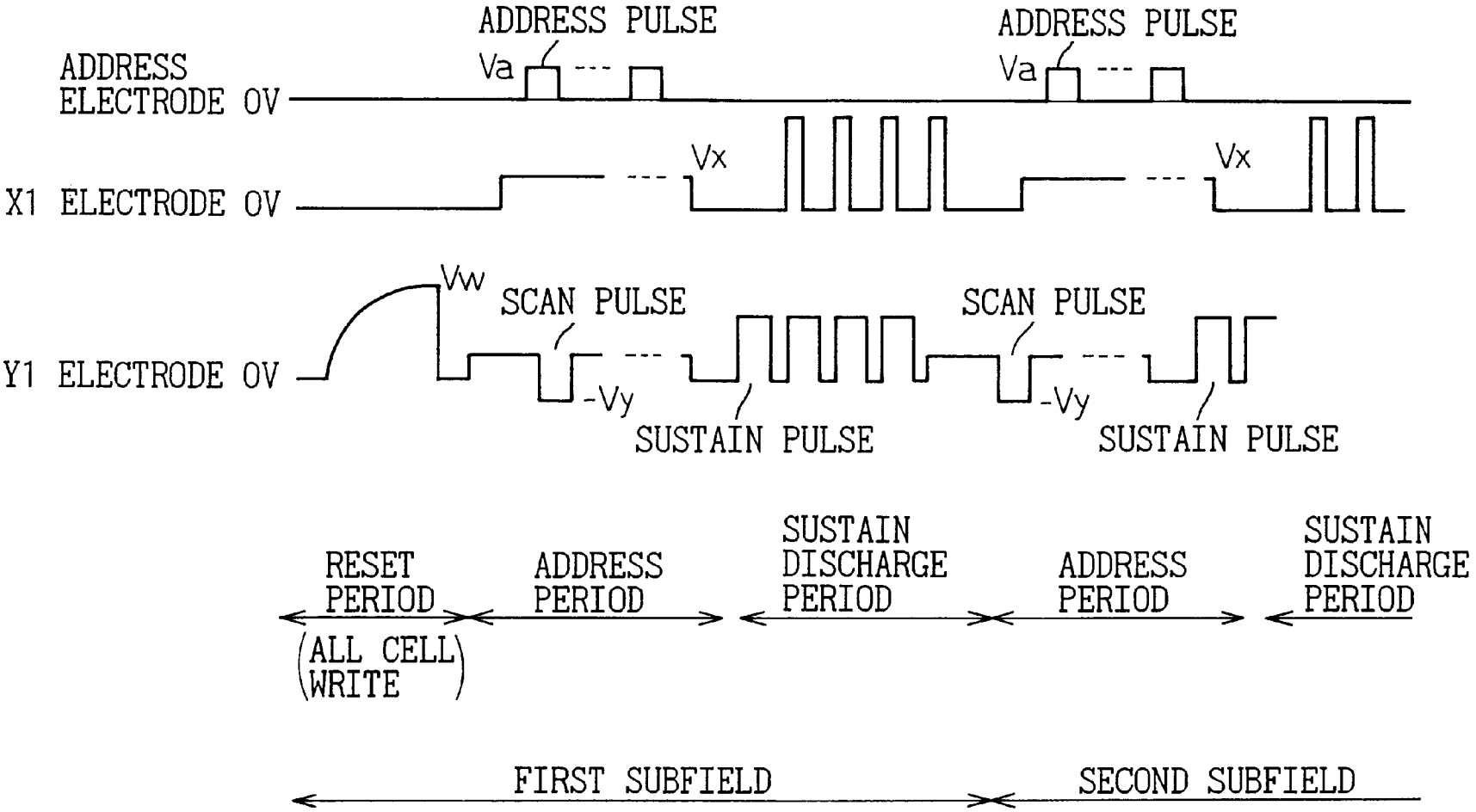
FIG. 14 is a diagram that shows the drive waveforms of the plasma display apparatus in the fourth embodiment of the present invention.

FIG. 14 is a diagram that shows the drive waveforms of the plasma display apparatus in the fourth embodiment of the present intention. The plasma display apparatus in the fourth embodiment has a structure similar to that in the first embodiment shown in FIG. 1 and is different from that in the first embodiment in that the erase address method is employed. FIG. 15A through FIG. 15E are diagrams that describe the discharge operations in the fourth embodiment.

As shown in FIG. 14, in the plasma display apparatus in the fourth embodiment, a frame is divided into the first and the second subfields, and write discharge to all the cells is caused to occur in the reset period in the first subfield, and no reset action is performed in the second subfield, but erase address discharge is caused to occur in the cell to be turned off in the first subfield.

Figure 15A:
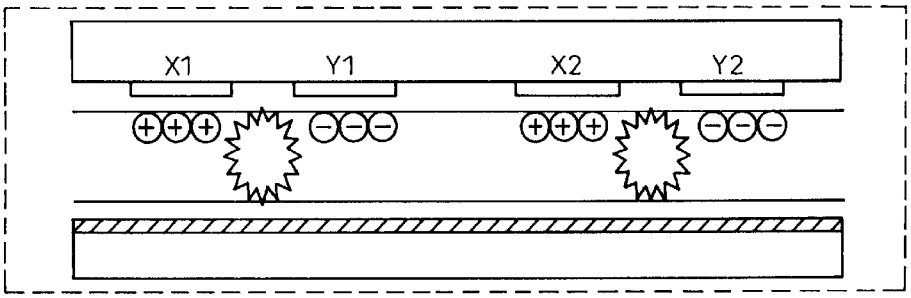
FIG. 15A through FIG. 15E are diagrams that show the change of the wall charges on the electrodes and the states of discharges in the four embodiments.
Figure 15B:
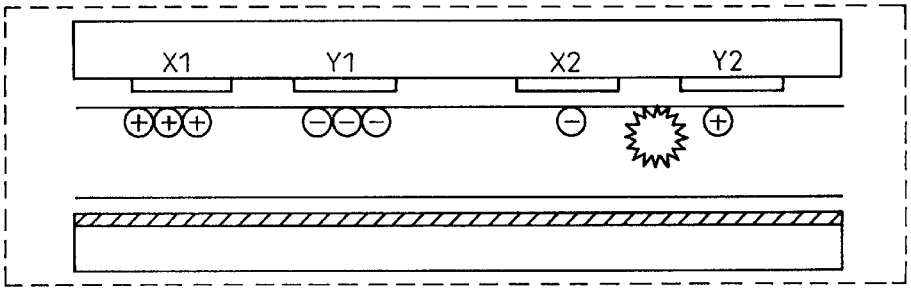

First, write discharge is caused to occur to all the cells by applying a waveform, the slope of which is gradual and the voltage of which reaches the voltage Vw, to the Y electrode. By this, many positive wall charges composed of ions are formed on the X electrodes and many negative wall charges composed of electrons are formed on the Y electrodes, as shown in FIG. 15A. In the next address period, with the voltage Vx (50 V) being applied to the X electrode, scan pulses of −Vy (−50 V) voltage are applied to the X electrodes sequentially, and synchronously with this, address pulses of Va voltage are applied to the address electrodes to carry out the address discharge to the cell to be turned off. By this, wall charges in the turned-off cell are reduced, and wall charges of the opposite polarities remain on the X electrode X2 and the Y electrode Y2, that is, negative wall charge remain on X2 and positive wall charges, on Y2, as shown in FIG. 15B. Since an address discharger is not carried out in the lit cell, many positive wall charges remain on the X1 electrode and many negative wall charges, on the Y1 electrode as is.

Figure 15C:
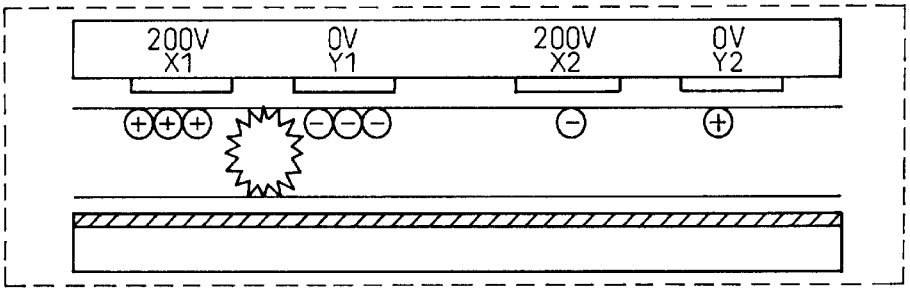
Figure 15D:
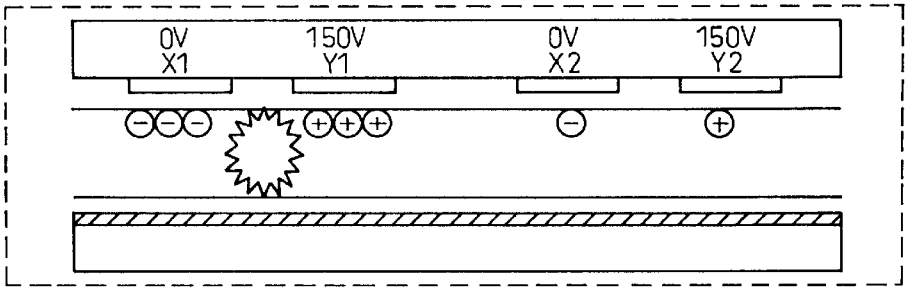
Figure 15E:
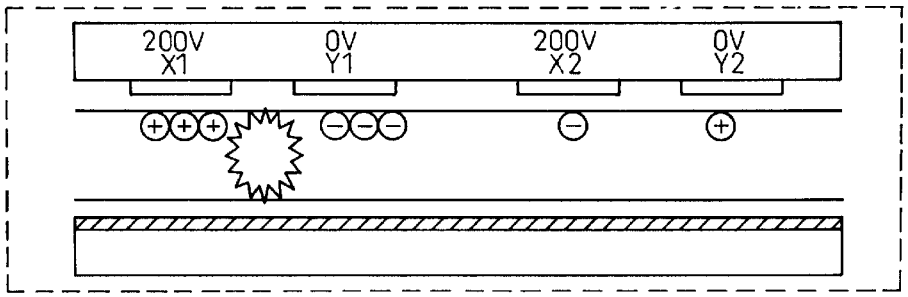

Next, in the sustain discharge period, the sustain discharge pulse similar to that shown in FIG. 4 is applied, but the polarity of wall charges is opposite to that in the first embodiment, therefore, narrow pulses of a high voltage (200 V) are applied to the X electrode, with the Y electrode being set to 0 V. In the lit cell, a discharge is caused to occur because the wall charges formed on the X1 ,electrode and the Y1 electrode are overlapped and the discharge start voltage is exceeded, but no discharge is caused to occur in the unlit cell because the wall charges that remain on the X2 electrode and the Y electrode have opposite polarity to that of the applied voltage, therefore, the discharge start voltage is not exceeded, as shown in FIG. 15C.

Next, with the X electrode being set to 0 V, the wide sustain discharge pulse of the low voltage Vs2 (150 V) is applied to the X electrode. At this time, since the voltage of the wall charges in the lit cell and that in the unlit cell have the same polarity, they serve to increase the absolute voltage between the X electrode and the Y electrode, and the absolute voltage of the wall charges in the lit cell is large and there exists the priming effect by the first sustain discharge, therefore, wall charges are formed in the lit cell even by a sustain discharge pulse of a low voltage Vs2 that causes a discharge to occur, but no discharge is caused to occur in the unlit cell because the absolute voltage of the residual wall charges on the X2 electrode and the Y2 electrode is small and the priming effect does not exist.

Subsequently, the application of the sustain discharge pulses is repeated.

The embodiments of the present invention are described above, and it is obvious that each parameter of the voltage and the pulse width is only an example, and the optimum values can be set according to such as characteristics of the panel.

Although only the subfields, to which the sustain discharge pulse is applied for light emission efficiency improvement, are described with reference to drawings, the sustain discharge pulse that has the same waveform and the same width as that of the conventional one can be applied to the X electrode and the Y electrode for the subfields the brightness weight of which is low, that is, those in which the number of times of sustain discharge is small. Moreover, in the display status in which the total brightness is set low, the power is also suppressed, therefore, it is acceptable that the conventional waveform is employed in all the subfields and the present invention is applied only when the brightness set high. It is also acceptable that the conventional waveform is employed for the first few to tens of discharges, and the sustain discharge pulses of the present invention are applied to other discharges.

As described above, according to the present invention, a plasma display apparatus that can control the discharge current to improve the light emission efficiency and provide a display of low power consumption and high quality by leaving wall charges of opposite polarities on the electrodes in the unlit cell and by optimizing the sustain discharge pulse with the help of the residual charges.

What is claimed is:

1. A method of driving a plasma display panel, comprising plural first and second electrodes arranged by turns and plural third electrodes provided so as to be apart from and perpendicular to said plural first and second electrodes, in which display cells are formed at crossings of said plural first and second electrodes and said plural third electrodes, and a reset period during which said display cells are initialized, an address period during which said display cells are set to appropriate states according to display data, and a sustain discharge period during which sustain discharge pulses of opposite polarities are applied alternately between said plural, first and second electrodes to selectively cause a light emission in said display cells that have been set to appropriate states according to said display data, are provided, wherein said driving method is characterized in that wall charges of a polarity opposite to those in a lit cell are left on said first and second electrodes in an unlit cell when said address period is completed; and said sustain discharge pulses of opposite polarities have first sustain discharge pulses of a first polarity and second sustain discharge pulses of the other polarity, an absolute value of a maximum voltage of at least part of said first sustain discharge pulses is greater than that of said second sustain discharge pulses, the polarity of said first sustain discharge pulses is opposite to that of voltage of the wall charges remaining in said unlit cell, the polarity of said second sustain discharge pulses is the same as that of a voltage of the wall charges remaining in said unlit cell, and a voltage of said first and second sustain discharge pulses overlapped by that of the wall charges remaining in said unlit cell is set so as to be lower than a discharge start voltage.

2. A method of driving a plasma display panel as set forth in claim, 1, wherein the width of at least part of said first sustain discharge pulses is narrower than that of said second sustain discharge pulses.

3. A method of driving a plasma display panel as set forth in claim 2, wherein a first pulse of said first sustain discharge pulses has the same width as that of said second sustain discharge pulses.

4. A method of driving a plasma display panel as set forth in claim 3, wherein at least either the said first or said second sustain discharge pulses are composed of a combined pulse of the two signals to be applied to said first and second electrodes.

5. A method of driving a plasma display panel as set forth in claim 1, wherein at least either said first or said second sustain discharge pulses are composed of a combined pulse of two signals to be applied to said first and second electrodes.

6. A method of driving a plasma display panel as set forth in claim 2, wherein at least either said first or said second sustain discharge pulses are composed of a combined pulse of two signals to be applied to said first and second electrodes.

7. A method of driving a plasma display panel as set forth in claim 3, wherein at least either said first or said second sustain discharge pulses are composed of a combined pulse of two signals to be applied to said first and second electrodes.

8. A method of driving a plasma display panel as set forth in claim 1, wherein: wall charges of opposite polarity to each other are left on said first and second electrodes, respectively, in said reset period; and in said address period, the wall charges remaining in said reset period are maintained in unlit cells, and wall charges of a polarity opposite to those remaining in said reset period are formed in lit cells.

9. A method of driving a plasma display panel as set forth in claim 1, wherein: wall charges of opposite polarity to each other are left on said first and second electrodes, respectively, in said reset period; and in said address period, the wall charges remaining in said reset period are maintained in lit cells, and wall charges of a polarity opposite to those remaining in said reset period are formed in unlit cells.

* * * * *

UNITED STATES PATENT AND TRADEMARK OFFICE

CERTIFICATE OF CORRECTION

PATENT NO. : 6,538,392 B2
DATED : March 25, 2003
INVENTOR(S) : Yoshikazu Kanazawa It is certified that error appears in the above-identified patent and that said Letters Patent is hereby corrected as shown below:

Column 10,
Lines 63-67, please replace claim 4 as follows:

-- 4. A method of driving a plasma display panel as set forth in claim 2, wherein at least part of said first sustain discharge pulses is composed of a narrow pulse of a large absolute voltage after which a pulse of a small absolute voltage of the same polarity is attached. --

Signed and Sealed this

Ninth Day of September, 2003

JAMES E. ROGAN
*Director of the United States Patent and Trademark Office*